US006070446A

United States Patent [19]

Blaimschein et al.

[11] Patent Number: 6,070,446

[45] Date of Patent: Jun. 6, 2000

[54] SWAGING MACHINE

[75] Inventors: Gottfried Blaimschein, Steyr; Alfred Seeber, Garsten/Steyr; Rupert Wieser, Seitenstetten, all of Austria

[73] Assignee: GFM Beteiligungs- und Management GmbH & Co. KG, Steyr, Austria

[21] Appl. No.: 09/187,668

[22] Filed: Nov. 6, 1998

[30] Foreign Application Priority Data

Nov. 13, 1997 [DE] Germany ..... 97890225

[51] Int. Cl.[7] ..... B21J 7/16

[52] U.S. Cl. ..... 72/76

[58] Field of Search ..... 72/76, 402

[56] References Cited

U.S. PATENT DOCUMENTS

| | | | |
|---|---|---|---|
| 2,388,643 | 11/1945 | Rode et al. | 72/100 |
| 3,135,139 | 6/1964 | Kralowetz | 72/76 |
| 3,572,077 | 3/1971 | Kralowetz et al. . | |
| 3,654,789 | 4/1972 | Brauer | 72/76 |

FOREIGN PATENT DOCUMENTS

| | | |
|---|---|---|
| 370 351 | 11/1981 | Austria . |
| 0 566 818 | 10/1993 | European Pat. Off. . |
| 0 610 510 | 8/1994 | European Pat. Off. . |
| 2 003 130 | 9/1970 | Germany . |
| 28 34 360 | 2/1980 | Germany . |
| 695 756 | 11/1979 | U.S.S.R. . |

*Primary Examiner*—Lowell A. Larson
*Attorney, Agent, or Firm*—Collard & Roe, P.C.

[57] ABSTRACT

A swaging machine (1) for swaging rod-shaped workpieces (W) has a ring-shaped forging box (3) supported in a machine frame (2) so as to be driven and rotated about the travel axis (A) of the workpiece (W), where in radial recesses (4) of the forging box forging punches (5) are accommodated which act against each other and can be lifted via a lifting drive (7) while the forging box rotates at the same time. To ensure swaging with a non-rotating workpiece (W) subjected to a pure longitudinal feed, the forging punches (5) are supported in the recesses (4) of the forging box (3) via pivotally mounted longitudinal guideways (13), and oscillating movements with a direction of movement lying in a normal plane (N) with respect to the travel axis (A) can be superimposed on the lifting movements of the forging punches (5) for swinging back the associated forging tools (6) relative to the forging box (13) during their contact with the workpiece at an angular velocity corresponding to the angular velocity of the rotation of the forging box, but directed in the opposite direction.

8 Claims, 3 Drawing Sheets

SWAGING MACHINE

FIELD OF THE INVENTION

This invention relates to a swaging machine for swaging rod-shaped workpieces, comprising a ring-shaped forging box supported in a machine frame so as to be rotated and driven about the travel axis of the workpiece, where in radial recesses of said forging box tool-carrying forging punches are accommodated, which act against each other and can be lifted via a lifting drive while the forging box rotates at the same time.

DESCRIPTION OF THE PRIOR ART

My means of usual continuous forging machines the rod-shaped workpiece is forged off under a pure longitudinal feed, so that because of the non-rotated workpiece it is possible to combine the forging operation with a continuous casting operation and/or a rolling operation, but due to the axial deformation planes firmly remaining with the workpiece such continuous forging necessarily involves zones of increased material stress in the overlap region of the forging tools, which leads to an overheating of the material and endangers the workpiece quality. To avoid such zones of increased material stress, an angular displacement of the deformation planes must be ensured for each blow of the hammer when forging off the rod-shaped workpiece, which displacement is effected in continuous forging machines by a rotary feed applied in addition to the longitudinal feed, and the workpiece is forged off under a rotation of the workpiece. This workpiece rotation in turn prevents a direct combination of the forging operation with a continuous casting and/or rolling operation, and as a prerequisite for such combination an intermediate storage point must have been prepared for the workpiece, as is proposed in EP 0 566 818 B.

Another possibility consists in the use of swaging machines, where the forging tools at the same time act radially on the workpiece and rotate relative to the workpiece, so that there is likewise obtained an angular displacement of the deformation planes. For this purpose, the known swaging machines have a forging box surrounding the workpiece in a ring-shaped manner and comprising radial guideways for the forging punches equipped with tools on the inside, where at the external end faces of the forging punches cambered rolling paths are formed for applying pressure by means of pressure rollers. In the case of a rotating forging box there is a relative movement between pressure rollers and forging box, and each rolling over the forging punches produces a radially inwardly directed pressure impulse, which is transferred as a forming force onto the forging tools and thus onto the workpiece. The radially guided forging punches, which together with the forging stroke necessarily follow the rotation of the forging box, entrain the workpiece in direction of rotation of the forging box due to a frictional engagement during the forming process, so that a rotary movement is forced on the workpiece via the forging tools, and the swaging machines have so far not allowed forging off under a pure longitudinal feed of the workpiece. Even the known swaging machines can accordingly not directly be used in conjunction with continuous casting plants and/or rolling plants.

It is therefore the object underlying the invention to create a swaging machine as described above, which provides for forming the workpiece without rotating the workpiece and offers the condition for a swaging operation going beyond the conventional swaging.

SUMMARY OF THE INVENTION

This object is solved by the invention in that the forging punches are supported in the recesses of the forging box by means of pivotally mounted longitudinal guideways, and oscillating movements with a direction of movement lying in a normal plane with respect to the travel axis can be superimposed on the lifting movements of the forging punches, which oscillating movements swivel back the associated forging tools relative to the forging box during their contact with the work-piece at an angular velocity corresponding to the angular velocity of the rotation of the forging box, but directed in the opposite direction. When forging off the workpieces, the rotary movement of the forging box during the lifting movements of the forging punches leads to an angular displacement of the deformation planes, so that there is no risk of overloading the workpiece material. However, the simultaneous oscillating movement of the forging tools directed opposite to the rotation of the forging box in addition ensures that the forging tools compensate the rotation of the forging box at least during their contact with the workpiece, and that there is no relative rotation between workpiece and forging tools. The workpiece can therefore not be put into a rotary movement via the tools due to occurring frictional forces, and there is actually effected a swaging operation without any rotation of the workpiece, which remains subjected to a pure longitudinal feed. Thus, all advantages of forging can be fully utilized with a non-rotating workpiece, and in particular forging can now be performed directly subsequent to a continuous casting process or be combined directly with a rolling process. In addition, when forging long bar stock above all of smaller dimensions loops may be formed between the individual work stations, which prevent a transfer of processing-related forces of gravity of the workpiece from one work station to the other.

A very expedient construction is obtained when as lifting drive there is provided an eccentric drive comprising eccentric shafts associated to the forging punches and supported in the forging box, which forging punches are pivotally mounted at the associated eccentrics like connecting rods with a head forming a pivot bearing. The forging punches directly seated on the eccentrics are subjected both to a lifting movement and to an oscillating movement due to the rotation of the eccentric in the case of a corresponding support by means of longitudinal guideway and swivel bearing, so that in the case of an appropriate adaptation of these components of movement to the deformation process on the one hand and the rotation of the forging box on the other hand, a common drive for the lifting movement and the oscillating movement will be sufficient.

When for driving the eccentric shafts there is provided an epicyclic gear comprising a central wheel coaxially supported with respect to the forging box and planetary wheels each associated to the eccentric shafts, the synchronous drive of all forging punches is ensured with an inexpensive construction, where due to the mutual angular displacement of the eccentricities of the eccentrics the blow sequence of the individual forging punches can easily be adjusted.

To achieve high cross-sectional reductions during the passage of the workpiece, the forging box has recesses for forging punches operating at least in two forging planes lying one behind the other, where the recesses of the one forging plane may be angularly offset with respect to the recesses of the other forging plane, so that the workpiece can simultaneously be forged in two or more passes during its passage, and a correspondingly large number of forging punches can be arranged without space problems.

In accordance with a further aspect of the invention, an oscillating movement can be superimposed on the lifting movement of the forging punches, where the direction of oscillation as a resultant is composed of a direction of movement lying in a normal plane with respect to the travel axis as one component and a direction of movement lying in an axial plane with respect to the travel axis as another component. It is thus possible to utilize the axially normal component of movement for a torque compensation of the machine box rotation for a non-rotating workpiece, but to additionally utilize the axial component of movement for a conveying effect in travel direction, which for instance also provides for the perfect swaging at larger travel speeds and helps to reduce the expenses for the longitudinal feeding means.

To achieve such obliquely aligned oscillating direction of the oscillating movement in a constructively simple way, the eccentric drive of the forging punches may have eccentric shafts with axes crossing the travel axis, so that the forging punches perform their oscillating movement corresponding to the normal planes with respect to these eccentric shaft axes.

A further possibility for an obliquely aligned forging punch oscillation is obtained in that for the head of the forging punches lateral guideways are provided which extend at an angle with respect to the mutually parallel travel and eccentric shaft axes, which likewise leads to an oscillating movement with a normal and an axial component.

BRIEF DESCRIPTION OF THE DRAWING

In the drawing, the subject-matter of the invention is represented by way of example, wherein.

DESCRIPTION OF THE PREFERRED EMBODIMENTS

Figure 1:
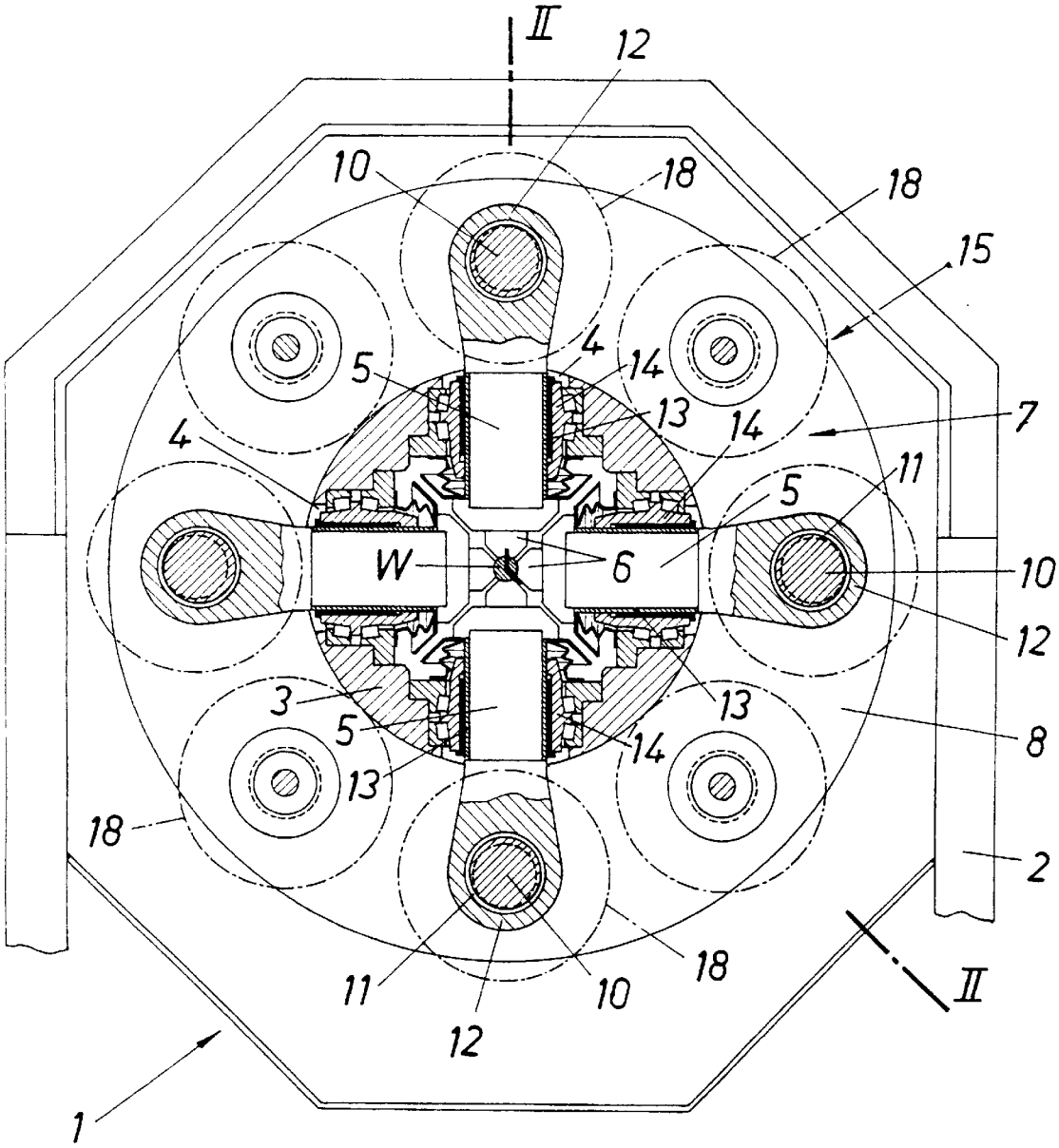
FIGS. 1 and 2 represent an inventive swaging machine in a cross-section along line I—I of FIG. 2 and in an axial section along line II—II of FIG. 1, and FIGS. 3 and 4 each represent a modified embodiment for the lifting drive of the forging punches in a schematic top view.

A swaging machine 1 for swaging rod-shaped workpieces W consists of a machine frame 2, in which a ring-shaped forging box 3 is supported so as to be rotated and driven about the travel axis A of the workpiece W. The forging box 3 has radial recesses 4 for accommodating forging punches 5 acting against each other and to be lifted while the forging box rotates at the same time, which forging punches are fitted with a forging tool 6 on the side facing the workpiece, and on the side facing away from the workpiece are equipped with a lifting drive designed as eccentric drive 7. The eccentric drive 7 comprises eccentric shafts 9 associated to the forging punches 5 and supported in annular walls 8 of the forging box 3, which eccentric shafts have eccentrics 10 on which the forging punches 5 are mounted like connecting rods by means of a head 12 forming a pivot bearing 11. The forging punches 5 are guided in longitudinal guideways 13, which are pivotally supported in the recesses 4 of the forging box 3 via swivel bearings 14, so that during a rotation of the eccentric, a lifting movement radial to the travel axis A and at the same time a swivel movement with a direction of movement lying in a normal plane N with respect to the travel axis A are forced on the forging punches 5 and thus on the forging tools 6.

For driving the eccentric shafts 9, there is provided an epicyclic gear 15 comprising a central wheel 17 rotatably supported on the outer periphery of the forging box 3 and to be driven for instance via a pulley 16, and planetary wheels 18 each associated to the eccentric shafts 9.

When for swaging a workpiece W, which may be both a bar stock and also a pipe stock, the forging box 3 is rotated by means of its drive merely indicated with a drive wheel 19 for forming the workpiece W, which is only subjected to a longitudinal feed in direction of movement, with a constant displacement of the deformation planes without a risk of overloading the material, the eccentric drive 7 at the same time leads to a lifting movement of the forging punches 5 and thus to a forging stroke of the forging tools 6, on which lifting movement, however, the oscillating movement of the forging punches is superimposed. When the axes E of the eccentric shafts extend parallel to the travel axis A (FIG. 2), the direction of oscilllation corresponds to a direction of movement lying in a normal plane N, and by means of an appropriate adaptation of the eccentric drive the oscillating movement can be adjusted such that during their contact with the workpiece the forging tools 6 are swung back with respect to the forging box 3 at an angular velocity corresponding to the angular velocity of the forging box itself, and there is no relative rotation between forging tools 6 and workpiece W, and the workpiece W is swaged without any rotation of its own.

Figure 2:
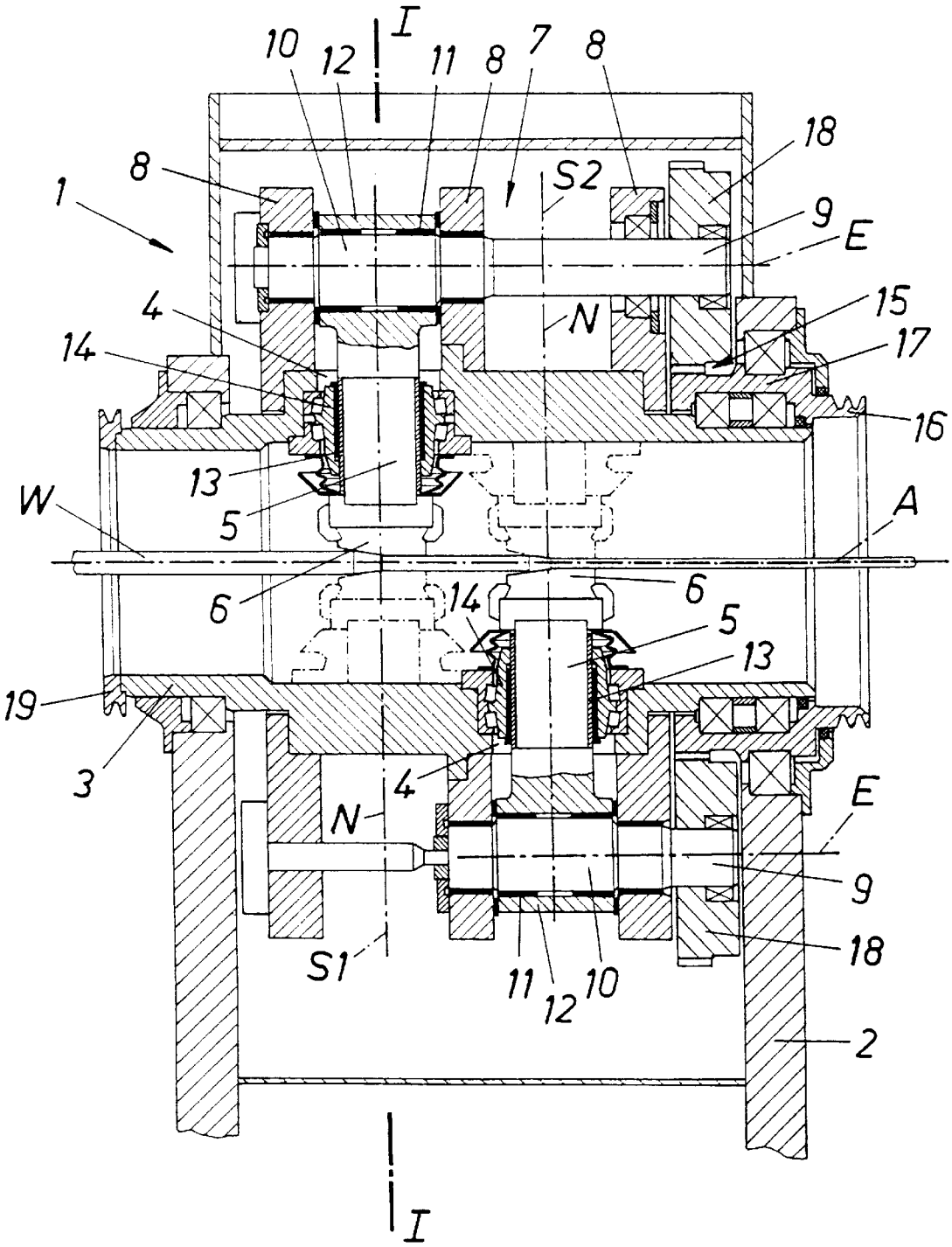

As is indicated in the embodiment shown in FIGS. 1 and 2, there are provided two forging planes I, II to increase the reduction of the cross-section, for which purpose the forging box 3 has two rings of recesses 4 offset with respect to each other with a gap for the forging punches 5 associated to these two forging planes I, II. However, it would of course also be possible to provide the swaging machine 1 with only one forging plane.

In order to compensate by means of the oscillating movement of the forging punches 5 not only the rotary movement of the forging box 3 during the workpiece contact of the tools 6, but to be able to utilize this oscillating movement also for a longitudinal conveyance of the workpiece W, the oscillating movement to be superimposed on the lifting movement of the punches 5 can be predetermined with a resulting oscillating direction, which is composed of a direction of movement lying in a normal plane with respect to the travel axis and of a direction of movement lying in an axial plane with respect to the travel axis, so that this component of axial movement then involves a conveying effect for the workpiece, but without imparting on the workpiece the undesired tendency to rotate.

Figure 3:
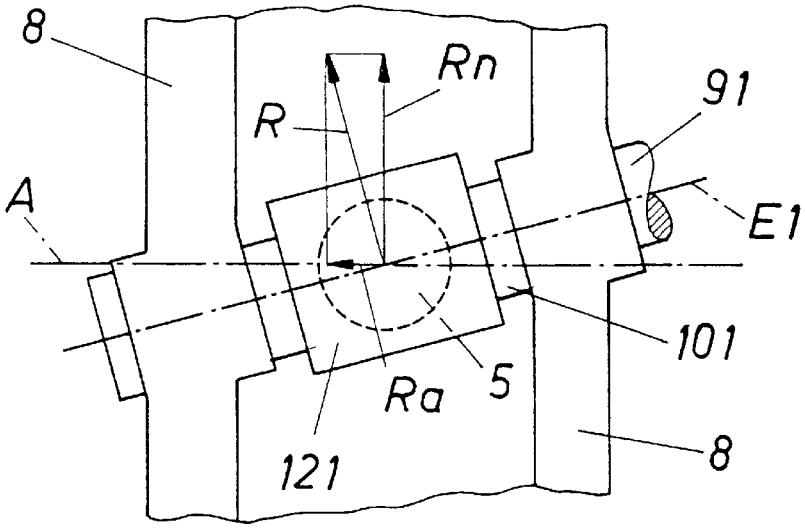

In order to achieve this, the eccentric drive 7 of the forging punches 5 may have eccentric shafts 91 with axes E1 crossing the travel axis A, as is shown in FIG. 3, so that for the forging punches 5 seated with their heads 121 on the eccentrics 101 there is obtained an oscillating direction R normal to the eccentric shaft axes E1, which can be divided into an axially normal component of movement Rn and an axial component of movement Ra, where the axially normal component of movement Rn must compensate the rotation of the forging box, and the axial component of movement Ra remains usable for the longitudinal conveyance of the workpiece.

Figure 4:
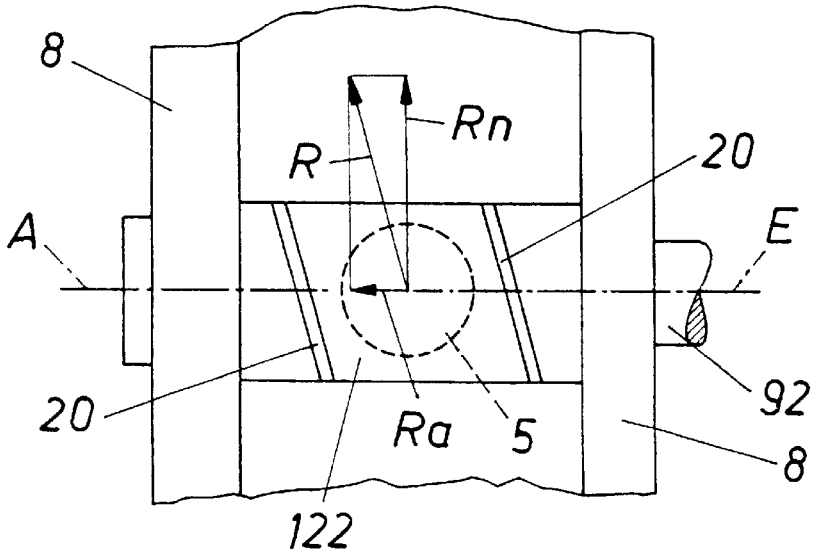

In accordance with the embodiment shown in FIG. 4, the eccentric shaft axes E of the eccentric shafts 92 extend parallel to the travel axis A, but for the head portion 122 of the forging punches 5 there are provided lateral guideways 20 extending at an angle with respect to the travel and eccentric shaft axes A, E, which lateral guideways in turn force the oscillating movement of the forging punches 5 into an oscillating direction R, which results from a normal component of movement Rn and an axial component of movement Ra.

What is claimed is:

1. A swaging machine for swaging rod-shaped workpieces, comprising a ring-shaped forging box supported in a machine frame so as to be rotated and driven about the travel axis of the workpiece, where in radial recesses of the forging box tool-carrying forging punches are accommodated, which act against each other and can be lifted via a lifting drive while the forging box rotates at the same time, characterized in that the forging punches are supported in the recesses of the forging box via pivotally mounted longitudinal guideways, and oscillating movements with a direction of movement lying in a normal plane with respect to the travel axis can be superimposed on the lifting movements of the forging punches, which oscillating movements swivel back the associated forging tools relative to the forging box during their contact with the workpiece at an angular velocity corresponding to the angular velocity of the rotation of the forging box, but directed in the opposite direction.

2. The swaging machine as claimed in claim 1, characterized in that as lifting drive there is provided an eccentric drive comprising eccentric shafts associated to the forging punches and supported in the forging box, which forging punches are pivotally mounted like connecting rods at the associated eccentrics with a head forming a pivot bearing.

3. The swaging machine as claimed in claim 2, characterized in that the eccentric drive of the forging punches has eccentric shafts with axes crossing the travel axis.

4. The swaging machine as claimed in claim 2, characterized in that for the head of the forging punches there are provided lateral guideways extending at an angle with respect to the mutually parallel travel and eccentric axes.

5. The swaging machine as claimed in claim 2, characterized in that for driving the eccentric shafts a common epicyclic gear is provided, comprising a central wheel supported coaxially with respect to the forging box, and planetary wheels each associated to the eccentric shafts.

6. The swaging machine as claimed in claim 1, characterized in that the forging box has recesses for forging punches operating in at least two forging planes lying one behind the other.

7. The swaging machine as claimed in claim 6, characterized in that the recesses (4) of the one forging plane (I) are angularly offset with respect to the recesses (4) of the other forging plane (II).

8. The swaging machine as claimed in claim 1, characterized in that on the lifting movement of the forging punches an oscillating movement can be superimposed, whose oscillating direction as a resultant is composed of a direction of movement lying in a normal plane with respect to the travel axis as one component and a direction of movement lying in an axial plane with respect to the travel axis as another component.

* * * * *

UNITED STATES PATENT AND TRADEMARK OFFICE

CERTIFICATE OF CORRECTION

PATENT NO. : 6,070,446
DATED : June 6, 2000
INVENTOR(S) : BLAIMSCHEIN ET AL

It is certified that error appears in the above-identified patent and that said Letters Patent is hereby corrected as shown below:

On the title page, column 1, line 2 of Item [30], please change

"[DE] Germany" to --[EPO] Europe--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*